US005205299A

United States Patent [19]

Chen

[11] Patent Number: 5,205,299

[45] Date of Patent: Apr. 27, 1993

[54] ASHTRAY

[76] Inventor: Ken W. Chen, 349, Ta-Wu Street, Tai-Nan City, Taiwan

[21] Appl. No.: 870,256

[22] Filed: Apr. 17, 1992

[51] Int. Cl.[5] ..... A24F 19/00; A24F 19/06

[52] U.S. Cl. ..... 131/241

[58] Field of Search ..... 131/231, 240.1-242, 131/329

[56] References Cited

U.S. PATENT DOCUMENTS

| | | | |
|---|---|---|---|
| 2,019,227 | 10/1935 | Jasper | 131/242 |
| 2,352,198 | 6/1944 | Hinson | 131/242 X |
| 2,508,575 | 5/1950 | Klekot | 131/242 X |
| 2,659,513 | 11/1953 | Morin | 131/242 X |
| 3,029,824 | 4/1962 | Goodell | 131/242 X |
| 3,285,463 | 11/1966 | Berliner | 131/242 |
| 3,300,079 | 1/1967 | Berliner | 131/242 X |

FOREIGN PATENT DOCUMENTS

| | | | |
|---|---|---|---|
| 581592 | 9/1958 | Italy | 131/242 |

*Primary Examiner*—Vincent Millin
*Assistant Examiner*—J. Doyle
*Attorney, Agent, or Firm*—Morton J. Rosenberg; David I. Klein

[57] ABSTRACT

This invention relates to an ashtray and in particular to including a base formed with a cavity at the central portion and internal threads at the upper portion, an upper annular member provided with a center hole, a plurality of recesses extending radially and slantwise towards the center line thereof, and external threads on the lower portion adapted to engage with the internal threads of the base, a support mounted across the diameter of the bottom of the upper annular member, an axle arranged on the center of the support with a ball member on the top end and a flange below the ball member, a permanent magnet mounted on the flange of the axle, a cover having a recess adapted to receive the ball member and a plurality of seats on the inner surface, and a plurality of elements made of ferrous metal embedded into the seats of the cover.

1 Claim, 5 Drawing Sheets

ASHTRAY

BACKGROUND OF THE INVENTION

Referring to FIG. 6, there is shown a prior art ashtray. As illustrated, the ashtray is formed at the central portion with a recess. Spaced apart on the top surface of the ashtray and a plurality of notches for receiving the cigarette such that the tobacco ash thereof may be collected in the recess. However, it has the following drawbacks:

1. The tobacco ash in the ashtray will scatter everywhere in case there is even a little wind.

2. The ash and the cigarette heads are not stored in an enclosed space and may be observed from outside hence blemishing the view.

Therefore, it is an object of the present invention to provide an ashtray which may obviate and mitigate the above-mentioned drawbacks.

SUMMARY OF THE INVENTION

This invention relates to an improved ashtray.

It is the primary object of the present invention to provide an ashtray which may prevent the ash from scattering everywhere.

It is another object of the present invention to provide an ashtray having a cover which may be easily opened.

It is still another object of the present invention to provide an ashtray which may keep the ash and cigarette heads from observing outside.

It is still another object of the present invention to provide an ashtray which may be dismantled for cleaning.

It is a further object of the present invention to provide an ashtray which is simple in construction.

Various objects, features and attendant advantages of the present invention will be more fully appreciated as the same becomes better understood from the following detailed description of the present invention when considered in connection with the accompanying drawings.

DETAILED DESCRIPTION OF THE PREFERRED EMBODIMENT

Before explaining the present invention in detail, it is understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
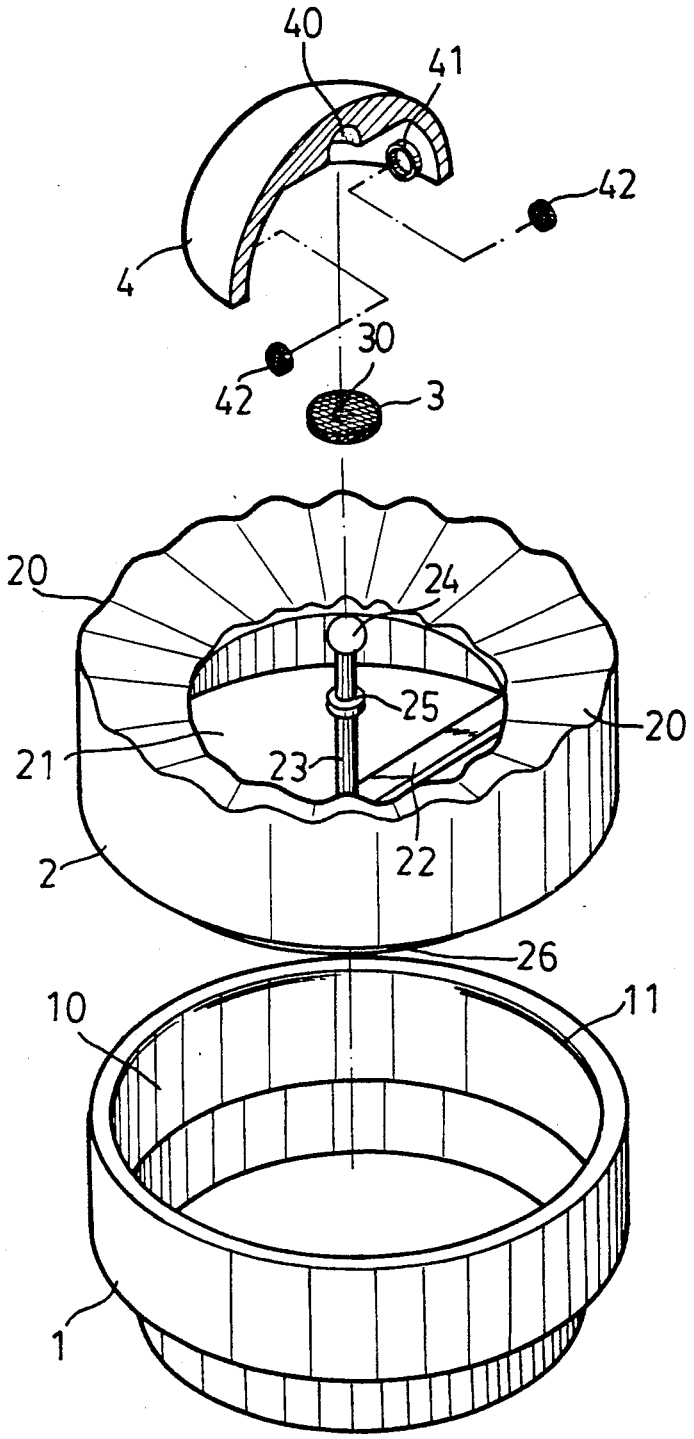
FIG. 1 is an exploded view of an ashtray according to the present invention.
Figure 2:
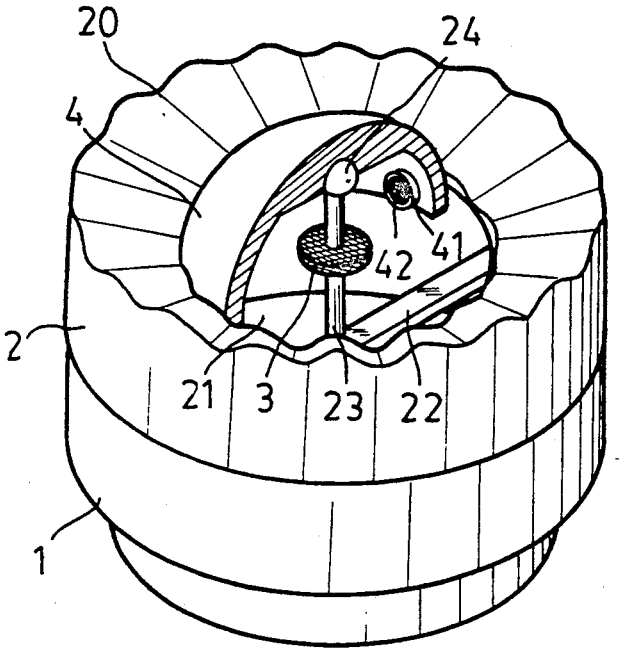
FIG. 2 is a perspective view of the ashtray.

With reference to the drawings and in particular to FIG. 1 thereof, the ash tray according to the present invention mainly comprises a base 1, an upper annular member 2, a magnet 3, and a cover 4.

The base 1 is formed with a cavity 10 and internal threads 11 at the upper portion.

The upper annular member 2 is provided with a plurality of recesses 20 extending radially and slantwise towards the center line of the upper annular member 2.

Further, the upper annular member 2 is formed with a center hole 21 across the lower part of which there is mounted a support 22. On the center of the support 22 there is an upright axle 23 with a ball member 24 on the top and a flange 25 below the ball member 24. In addition, the upper annular member 2 is provided on the lower edge with external threads 26 adapted to engage with the internal threads 11 of the base 1.

The permanent magnet 3 mounted on the flange 25 of the axle 23.

The cover 4 is formed with a recess 40 adapted to receive the ball member 24 and a plurality of seats 41 on the inner surface. Each of the seats 41 is designed to receive an element 42 made of ferrous metal.

In assembly, the permanent magnet 3 is first put on to the flange 25 of the axle 23. Then, mount the ball member 24 on the top end of the axle 23 and engage the elements 42 with the seats 41. Thereafter, turn the upper annular member 2 onto the base 1 by engaging the external threads 26 of the former with the internal threads 11 of the latter. Finally, dispose the cover 4 on the ball member 24 of the axle 23.

Figure 3:
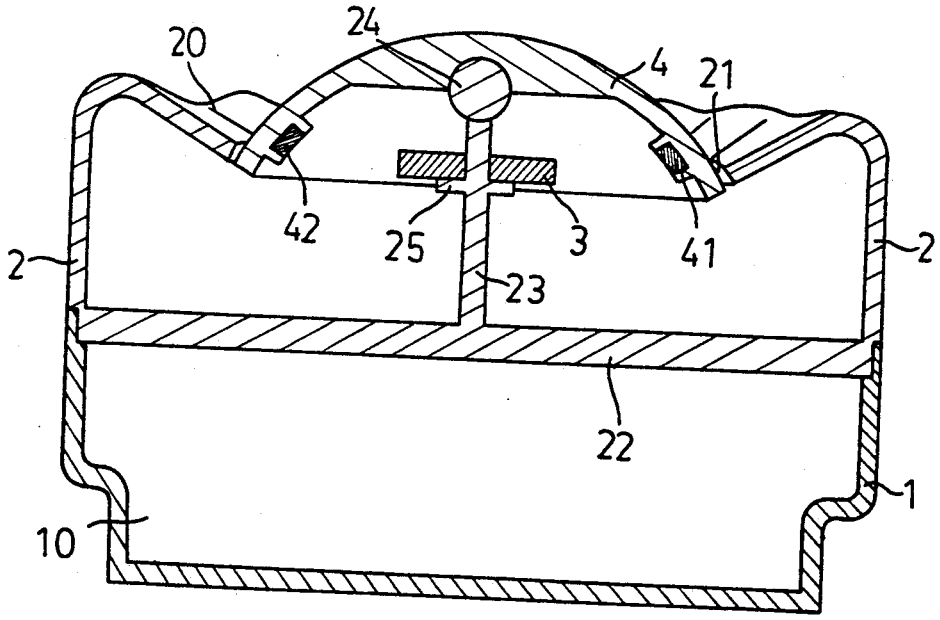
FIG. 3 is a sectional view of the ashtray.
Figure 5:
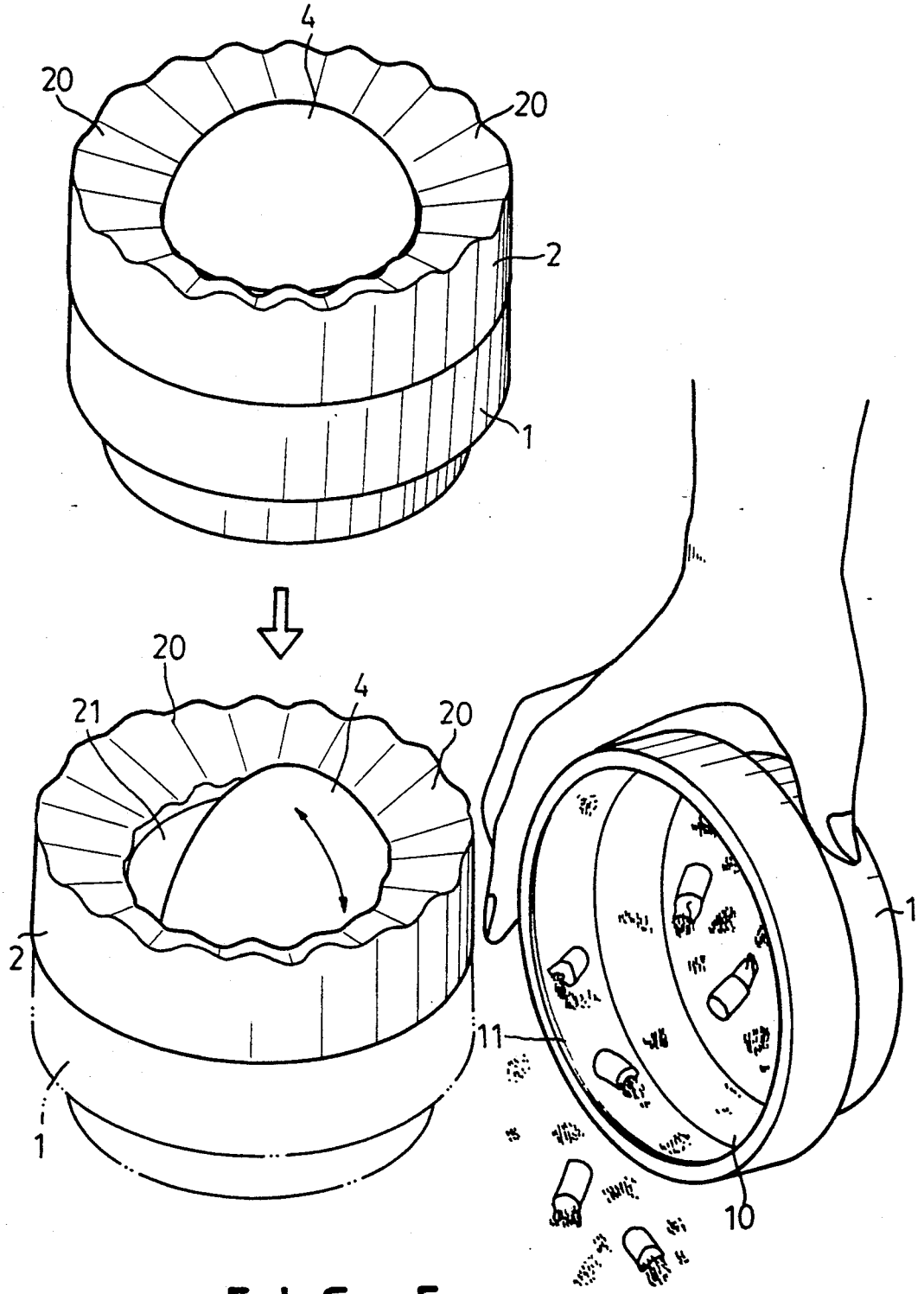
FIG. 5 is a working view of the ashtray.
Figure 6:
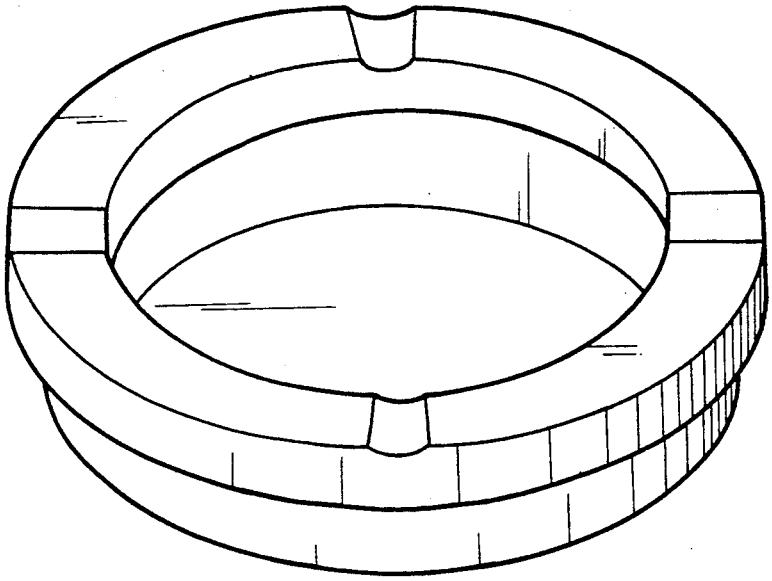
PRIOR ART FIG. 6
FIG. 6 is a perspective view of a prior art ashtray.

When the cover 4 is not subject to external force (see FIG. 3), it will be kept in a steady and equilibrium position due to attraction between the elements 42 and the permanent magnet 3.

Figure 4:
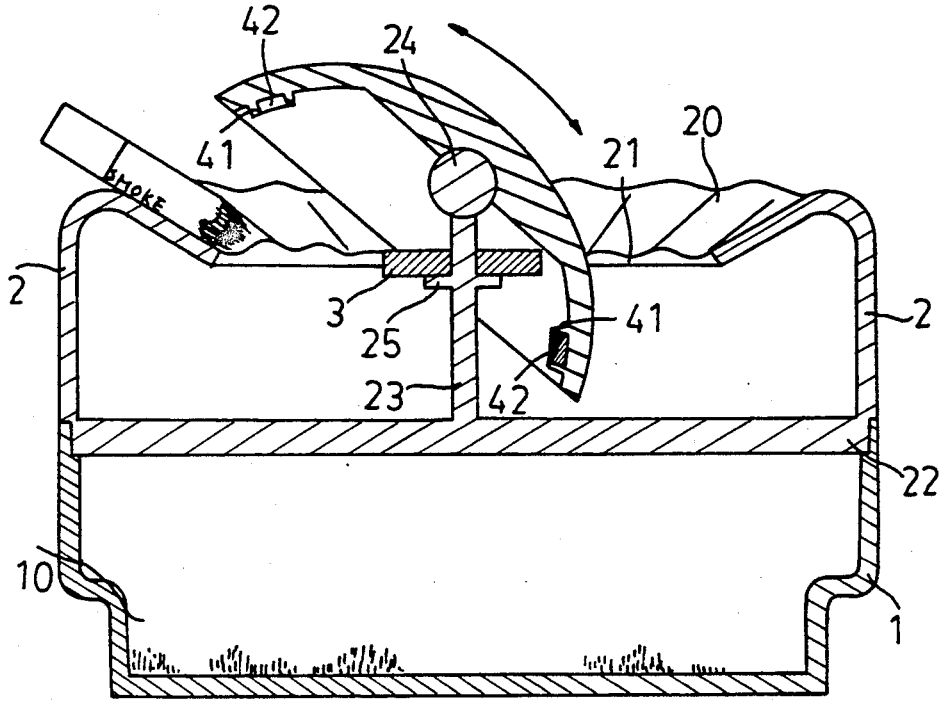
FIG. 4 shows the principle of the ashtray.

As shown in FIG. 4, when cover 4 is applied with a downward force on one side, the cover 4 will be moved to an inclined position where the elements 41 at the lower position will be nearer than the elements 41 at the upper position so that the cover 4 will be kept at an inclined position. Hence, one may drop cigarette ash or cigarette head into the recess 20 of the upper annular member 2. When not in use, it is only necessary to press cover 4 on the opposite side so that the elements 41 have the same distance from the magnet 3 thereby keeping the cover 4 at a steady and equilibrium position.

When desired to remove the ash and cigarette heads from the base 1, simply disengage the upper annular member 2 from the base 1 and pour out the ash and cigarette heads of the base 1.

The application of the present invention is too wide to be mentioned and cannot be all enumerated here in detail. It is understood that the present disclosure is made by way of example only and that numerous changes in the detail of construction and the combination of parts may be resorted to without departing from the spirit and scope of the invention as hereinafter claimed.

I claim:

1. An ashtray comprising:

a base formed with a cavity at a central portion and internal threads at an upper portion;

an upper annular member provided with a center hole, a plurality of recesses extending radially and slantwise towards the center hole thereof, and external threads on a lower portion adapted to engage with the internal threads of said base;

a support mounted across a diameter of bottom of said upper annular member;

an axle arranged on the center of said support with a ball member on a top end and a flange below said ball member;

a permanent magnet mounted on the flange of said axle;

a cover having a recess adapted to receive said ball member and a plurality of seats on an inner surface; and a plurality of elements made of ferrous metal embedded into the seats of said cover.

* * * * *